US008040033B2

(12) United States Patent
Zhokhavets et al.

(10) Patent No.: US 8,040,033 B2
(45) Date of Patent: Oct. 18, 2011

(54) ELECTRODE DEVICE FOR GAS DISCHARGE SOURCES AND METHOD OF OPERATING A GAS DISCHARGE SOURCE HAVING THIS ELECTRODE DEVICE

(75) Inventors: Uladzimir Zhokhavets, Aachen (DE); Thomas Kruecken, Aachen (DE); Guenther Hans Derra, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 6 days.

(21) Appl. No.: 12/674,951

(22) PCT Filed: Sep. 3, 2008

(86) PCT No.: PCT/IB2008/053560

§ 371 (c)(1),
(2), (4) Date: Feb. 24, 2010

(87) PCT Pub. No.: WO2009/031104

PCT Pub. Date: Mar. 12, 2009

(65) Prior Publication Data

US 2011/0133641 A1 Jun. 9, 2011

(30) Foreign Application Priority Data

Sep. 7, 2007 (EP) ..... 07115920

(51) Int. Cl.
*H05G 2/00* (2006.01)
*H01J 1/02* (2006.01)

(52) U.S. Cl. ..... 313/326; 313/631; 313/231.71; 378/121

(58) Field of Classification Search ..... None
See application file for complete search history.

(56) References Cited

U.S. PATENT DOCUMENTS

2009/0250638 A1* 10/2009 Jonkers et al. ..... 250/493.1

FOREIGN PATENT DOCUMENTS

| | | | |
|---|---|---|---|
| EP | 1729550 | A2 | 12/2006 |
| WO | 2005025280 | A2 | 3/2005 |
| WO | 2006123270 | A2 | 11/2006 |
| WO | 2007051537 | A2 | 5/2007 |

* cited by examiner

*Primary Examiner* — Ashok Patel

(57) ABSTRACT

The present invention relates to an electrode device for gas discharge sources, a gas discharge source comprising such an electrode device and to a method of operating the gas discharge source. The electrode device comprises an electrode wheel (1) rotatable around a rotational axis (3) and a wiper unit (11) arranged to limit the thickness of a liquid material film applied to at least a portion of an outer circumferential surface (18) of the electrode wheel (1) during rotation of said electrode wheel (1). The wiper unit (11) is arranged and designed to form a gap (17) between the outer circumferential surface (18) and a wiping edge (19) of the wiper unit (11) and to inhibit or at least reduce a migration of liquid material from side surfaces to the outer circumferential surface (18) of the electrode wheel (1) during rotation. With the proposed electrode device the electrode wheel (1) can be rotated at higher rotational speeds without the formation of droplets resulting in a higher output power and pulse frequency of a gas discharge source having such an electrode device.

12 Claims, 5 Drawing Sheets

ELECTRODE DEVICE FOR GAS DISCHARGE SOURCES AND METHOD OF OPERATING A GAS DISCHARGE SOURCE HAVING THIS ELECTRODE DEVICE

FIELD OF THE INVENTION

The present invention relates to an electrode device for gas discharge sources at least comprising an electrode wheel rotatable around a rotational axis, said electrode wheel having an outer circumferential surface between two side surfaces, and a wiper unit arranged to limit the thickness of a liquid material film applied to at least a portion of said outer circumferential surface during rotation of said electrode wheel. The invention further relates to a gas discharge source comprising such an electrode device and to a method of operating the gas discharge source with this electrode device.

BACKGROUND OF THE INVENTION

Gas discharge sources are used, for example, as light sources for EUV radiation (EUV: extreme ultra violet) or soft x-rays. Radiation sources emitting EUV radiation and/or soft x-rays are in particular required in the field of EUV lithography. The radiation is emitted from hot plasma produced by a pulsed current. The most powerful EUV radiation sources known up to now are operated with metal vapor to generate the required plasma. An example of such a EUV radiation source is shown in WO 2005/025280 A2. In this known radiation source the metal vapor is produced from a metal melt which is applied to a surface in the discharge space and at least partially evaporated by an energy beam, in particular by a laser beam. In a preferred embodiment of this radiation source the two electrodes are rotatably mounted forming electrode wheels which are rotated during operation of the radiation source. The electrode wheels dip during rotation into containers with the metal melt. A pulsed laser beam is directed directly to the surface of one of the electrodes in the discharge region in order to generate the metal vapor from the adhered metal melt and ignite the electrical discharge. The metal vapor is heated by a current of some kA up to some 10 kA so that the desired ionization stages are excited and light of the desired wavelength is emitted. The liquid metal film formed on the outer circumferential surfaces of the electrode wheels serves as the radiating medium in the discharge and protects as a regenerative film the wheel from erosion.

For stable EUV radiation output of such a EUV discharge lamp, it is required that consecutive discharge pulses are hitting always a fresh smooth portion of the electrode surfaces. The distance of consecutive discharge pulses on the moving electrode surface is in the order of a few tenths of millimeter up to a few millimeters. Increasing the power of the lamp is possible mainly by increasing the repetition rate of the discharge. Therefore, the electrode rotational speed must be increased accordingly.

It has been found experimentally, that the film thickness of the liquid metal film on the rotating electrode increases with increasing rotational frequency due to the higher centrifugal forces. At high rotational frequencies, the film thickness can reach several hundreds of microns, resulting in the formation of liquid metal droplets spraying off the electrode surface. These droplets can cause short circuits in the lamp and thus lamp failure. Moreover, a varying film thickness of the liquid metal film influences the effective distance between the electrodes. This requires an optimization of the operational parameters of the lamp for each rotational frequency. WO 2005/025280 A2 discloses the use of strippers or wipers in order to ensure a limited thickness of the liquid material film applied to the outer circumferential surface of the electrode wheels. Nevertheless, the rotational frequency of the electrode wheels is limited due to the formation of droplets or instabilities of the liquid metal film at higher rotational speeds.

SUMMARY OF THE INVENTION

It is an object of the present invention to provide an electrode device for use in a gas discharge source as well as a method for operating a gas discharge source with such an electrode device, which allow a stable operation at higher rotational frequencies to achieve a higher output power.

The object is achieved with the electrode device, the gas discharge source and the method of operating the gas discharge source according to claims 1 and 11. Advantageous embodiments of the electrode device, gas discharge source and method are subject matter of the dependent claims or are disclosed in the subsequent portion of the description.

The proposed electrode device at least comprises an electrode wheel rotatable around a rotational axis, said electrode wheel having an outer circumferential surface between two side surfaces, and a wiper unit arranged to limit the thickness of a liquid material film applied to at least a portion of said outer circumferential surface during rotation of said electrode wheel. The wiper unit is arranged and designed to form a gap between said outer circumferential surface and a wiping edge of the wiper unit and to inhibit or at least reduce a migration of liquid material from said side surfaces to the circumferential surface during rotation of the electrode wheel.

It has been found that the electrode wheel of such an electrode device, compared to the known electrode device disclosed in WO 2005/025280 A2, can be rotated at higher rotational speeds due to the wiper unit which inhibits or at least reduces a flow of liquid material from the side surfaces of the wheel to the outer circumferential surface. Such a measure is not realized with the wiper of WO 2005/025280 A2, which only controls the film thickness on the outer circumferential surface. The reduction of this flow or migration allows an improved control of the total amount of liquid material on the outer circumferential surface of the wheel and its distribution on this surface. Therefore, the thickness of the liquid material film on the rotating electrode wheel can be effectively limited even at higher rotational speeds to form a stable film which is maintained with sufficient thickness at the discharge region. With this measure higher rotational speeds are achieved compared to electrode devices which do not have such a wiper unit suppressing or reducing the migration of liquid material from the side surfaces to the outer circumferential surface and reducing the amount of liquid metal on the circumferential surface.

Using such an electrode device in a gas discharge source as at least one of the electrodes, the higher rotational speed of the electrode wheel allows raising the pulse frequencies for forming a pulsed gas discharge, as long as two consecutive pulses for evaporating the liquid material do not overlap on the electrode surface. Such a gas discharge source preferably comprises two electrodes which are arranged to have a smallest distance at the discharge region, a power supply for applying high voltage between the two electrodes and a device for applying the liquid material film on at least a portion of the outer circumferential surface of the electrode wheel. Alternatively the material may be applied as a solid material on the outer circumferential surface of the electrode wheel and then heated to form a liquid material film on at least a portion of this outer circumferential surface. In a preferred embodiment both electrodes are electrode wheels with the corresponding wiper units according to the proposed electrode device.

The wiper unit may be formed of one single wiper element or of several wiper elements acting together. The single wiper element or wiper elements are preferably arranged and designed to strip off liquid material at portions of said side surfaces adjacent to the circumferential surface during rotation of said electrode wheel. To this end the corresponding wiper element may be formed to have a fork-like shape at the portion facing the circumferential surface of the electrode wheel. The wiper element defines a gap between the circumferential surface and a wiping edge of the wiper element which gap is closed on both sides by the side pieces of the wiper element touching or nearly touching the side surfaces of the electrode wheel. This gap between the circumferential surface and a wiping edge of the wiper element is necessary in order to limit the thickness of the liquid material film to a desired height. By specially shaping the wiping edge of the wiper element and/or the electrode wheel bordering this gap, a desired shape of the liquid material film can be achieved. For example, the outer circumferential surface of the electrode wheel can have a planar shape or a curved shape over its width. Furthermore, the outer circumferential surface may also comprise a groove extending in the circumferential direction of the electrode wheel. In one of the preferred embodiments, the outer circumferential surface has a planar shape over its width and the wiper unit at the same time is designed to form a gap of a constant thickness over this width of the outer circumferential surface.

Although in the above examples or preferred embodiments one of the wiper elements is designed to form the gap and at the same time to strip off liquid material from the side surfaces of the electrode wheel, it is also possible to use one of the wiper elements to form the gap and one or several further wiper elements to strip off liquid material at portions of the side surfaces of the electrode wheel. Furthermore, several wiper units may be arranged at different positions of the circumferential surface with respect to the rotational direction in order to further improve the shaping of the liquid material film on the circumferential surface. Preferably such a further wiper unit is designed similar to the main wiper unit, having one or several wiper elements limiting the thickness of the liquid material film on the surfaces of the wheel. Said further wiper unit is then arranged in a rotational direction before said main wiper unit.

Preferably further measures are taken to reduce the amount of liquid material which may migrate during rotation of the electrode wheel from the side surfaces to the circumferential surface. One of these measures is to use an electrode wheel which has a T-shaped cross section at the outer circumferential surface. Due to this T-shaped form the liquid material can not access the outer circumferential surface on a straight way but has to move around a protrusion. A further preferable measure is to apply a non-wetting layer or coating on the side surfaces of the electrode wheel. It goes without saying that the outer circumferential surface on the other hand must consist of a wetting material or be coated with such a material.

Between the wiper unit and the discharge region the liquid material film is subject to centrifugal, viscous and surface tension forces which influence the film thickness profile dynamically and can lead to formation of liquid material droplets. To have a maximum control of the liquid material film evolution and/or to achieve the highest possible rotational frequencies without droplets formation all of the measures disclosed in this patent application may be applied at the same time. The different measures can also be individually combined.

In order to allow an optimal adjustment of the gap for controlling the film thickness of the liquid material on the outer circumferential surface, the distance of the wiping edge defining this gap and the outer circumferential surface of the electrode wheel is preferable adjustable by using an adjustable wiper element. This allows the proper setting of the gap dependent on the rotational frequency and the properties of the liquid material used when operating the gas discharge source.

It has been found that highest rotational frequencies are achieved with stable liquid material films if the cross sectional area of the gap in the plane perpendicular to the rotational direction does not exceed a maximum area $A_{max}$, with:

$$A_{max}=8\sigma/(\rho\omega^2 R),$$

wherein $\sigma$ and $\rho$ are the surface tension and the density of the liquid material, respectively, $\omega=2\pi\cdot f$ is the angular rotation frequency and R is the wheel radius. This gap defines the liquid material film profile at the wiper location and controls the total liquid material amount and the liquid material film profile at the discharge location. For high stability of the film at high rotational speeds a small gap is required. On the other hand, the gap must be chosen large enough, such that enough liquid material is available to ensure the required film thickness of the order of several tens of micrometers at the discharge location. In the proposed method of operating a gas discharge source having the proposed electrode device, the area of the gap is therefore controlled to fulfill the above equation. In one of the embodiments of the proposed gas discharge source, the constant thickness of the gap is controlled automatically by an appropriate sensor and an appropriate control unit during operation of the gas discharge source.

In the proposed method of operating such a gas discharge source, preferably an electrode wheel having an outer circumferential surface is used, which has a cross section of rectangular shape or at least has a rectangular shape at a portion of the cross sectional profile. The width D of the electrode wheel or at least a the rectangular part of its cross section is chosen to be in the range of $D^*<D<10\cdot D^*$, with $D^*=\pi\sqrt{\sigma(\rho\omega^2 R)}$. It has been found that with an electrode wheel fulfilling the above equation, maximum rotational frequencies without droplets formation are achieved in combination with some or all the above further measures.

To maintain a defined gap thickness between the wiper element and the outer circumferential surface of the wheel, the wiper can be pressed on the wheel surface by an elastic element like a spring resulting in an effect like with a hydrodynamic bearing. In such a case, a definite film thickness is achieved dependent on the rotational speed and the elastic force pressing the wiper element against the surface. Alternatively, the gap thickness and thus the thickness of the liquid material layer can be controlled, for example by rolling elements on the wiper unit, which define the distance of the wiper element to the outer circumferential surface of the electrode wheel.

In order to achieve a maximum control of the thickness of the liquid material film at the discharge region or location, the wiper unit should be arranged as close as possible to this discharge location. Furthermore, the wiper material must be mechanically stable and chemically and thermally resistant against the hot liquid material. An example for an appropriate material in the case of liquid tin (Sn) is tungsten or molybdenum. Furthermore, in order to achieve the highest possible circumferential velocities $v=\omega\cdot R$ and therefore the highest discharge repetition frequencies, the wheel radius should be chosen as large as possible, compatible with the other requirements.

These and other aspects of the invention will be apparent from and elucidated with reference to the embodiments described herein after.

BRIEF DESCRIPTION OF THE DRAWINGS

The proposed electrode device, gas discharge source and method of operation are described in the following by way of examples in connection with the accompanying figures without limiting the scope of protection as defined by the claims. The figures show:

DETAILED DESCRIPTION OF EMBODIMENTS

Figure 1:
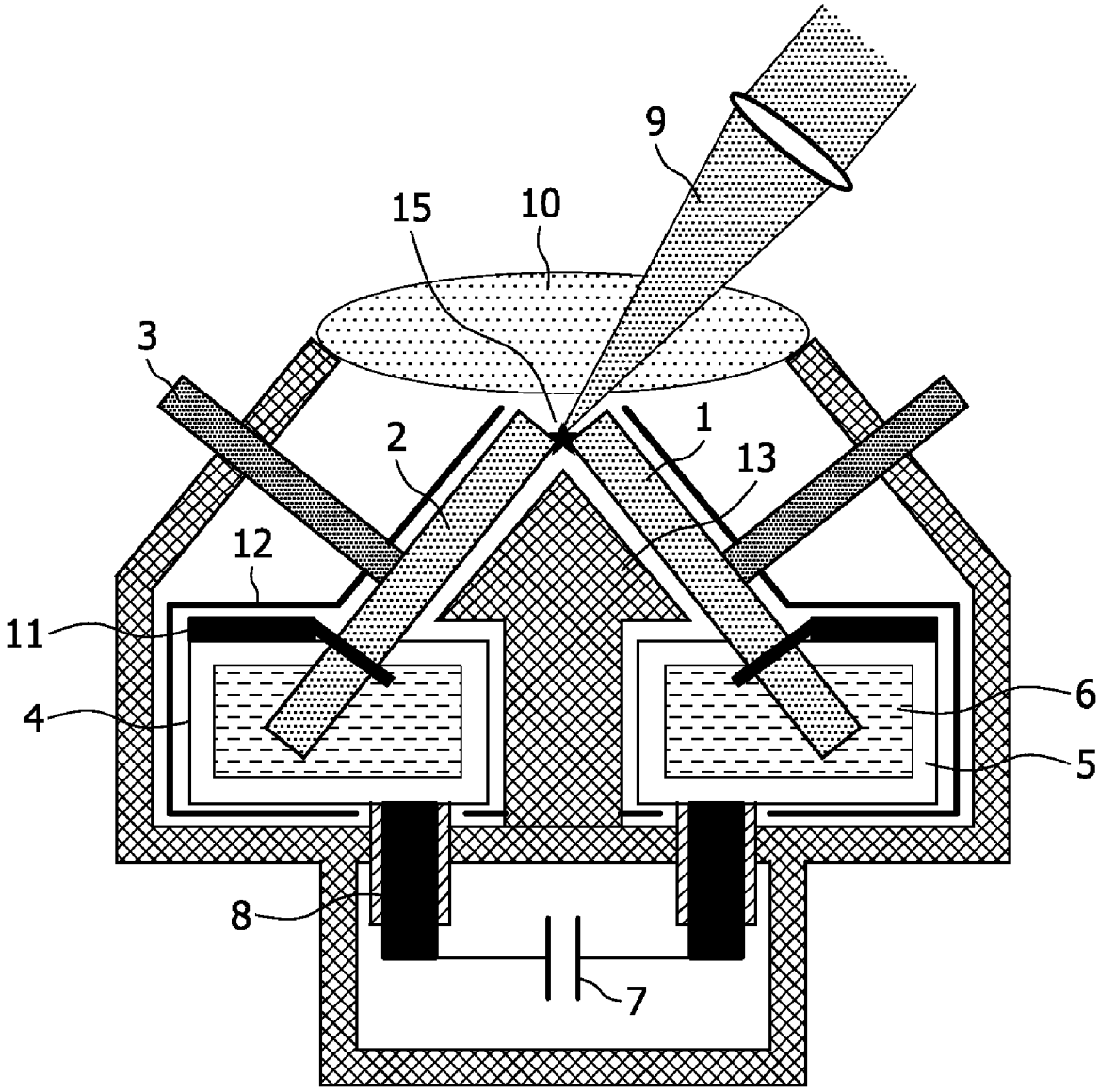
FIG. 1 a schematic view of a gas discharge source with an electrode device according to the present invention.

FIG. 1 shows a schematic side view of a pulsed gas discharge source, in which an electrode device according to the present invention may be implemented. Details of this electrode device are not shown in the figure. The gas discharge source comprises the two electrodes 1, 2 arranged in a discharge space of pre-definable gas pressure. The wheel shaped electrodes 1, 2 are rotatable mounted, i.e. they are rotated during operation about a rotational axis 3. During rotation the electrodes 1, 2 partially dip into corresponding containers 4, 5. Each of these containers 4, 5 contains a metal melt 6, in the present case liquid tin. The metal melt 6 is kept on a temperature of approximately 300° C., i.e. slightly above the melting point of 230° C. of tin. The metal melt in the containers 4, 5 is maintained at the above operation temperature by a heating device or a cooling device (not shown in the figure) connected to said containers. During rotation the outer circumferential surfaces of the electrodes 1, 2 are wetted by the liquid metal so that a liquid metal film forms on said electrodes. The layer thickness of the liquid metal film on the outer circumferential surface of the electrodes 1, 2 is controlled by a wiper unit 11 only schematically indicated in FIG. 1. Examples of this wiper unit 11 are shown in FIGS. 3 to 7. The current to the electrodes 1, 2 is supplied via metal melt 6, which is connected to the capacitor bank 7 via an insulated feed through 8.

A pulsed laser beam 9 is focused on one of the electrodes 1, 2 at the narrowest point between the two electrodes. As a result, part of the metal film located on the electrodes 1, 2 evaporates and bridges over the electrode gap. This leads to the ignition of an electrical discharge at this point and a very fast current rise powered by the capacitor bank 7. The high current heats the metal vapor or fuel to such high temperatures that the latter is ionized and emits the desired EUV radiation in a pinch plasma 15.

In order to prevent the fuel from escaping from the gas discharge source a debris mitigation unit 10 is arranged in front of the gas discharge source. This debris mitigation unit 10 allows the straight pass of radiation out of the gas discharge source but retains a high amount of debris particles on their way out. In order to avoid the contamination of the housing of the gas discharge source a screen 12 may be arranged between the electrodes 1, 2 and the housing. Furthermore, a metal shield 13 is arranged inside the gap between the two containers 4, 5 in order to reduce the diffusion of fuel into this gap.

Figure 2:
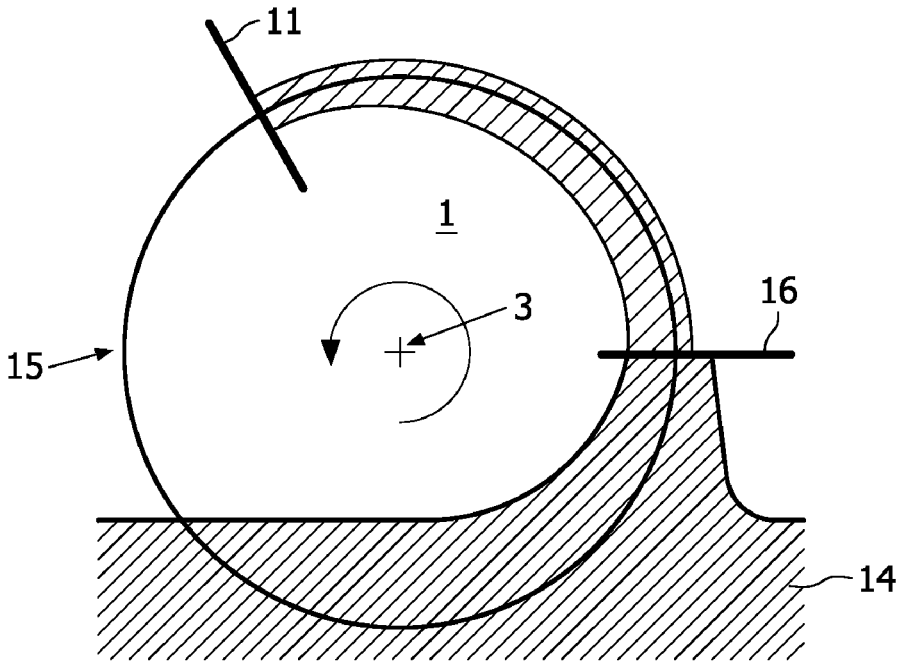
FIG. 2 schematic sides view of an electrode wheel with a wiper unit and an additional wiper element serving as a pre-wiper.

FIG. 2 shows a schematic side view of the electrode wheel 1 of FIG. 1. The rotating wheel 1 is in contact with a liquid metal supply 14 formed by container 5 in FIG. 1, in which the wheel is partially submersed. On the way between the liquid metal supply 14 and the discharge location indicated by pinch plasma 15, where part of the liquid metal film will be ablated which each laser pulse, the liquid metal film forming on the outer circumferential surface of electrode wheel 1 is first shaped by an optional pre-wiper 16 and then by a main wiper 11 as indicated in FIG. 2.

The shapes of the circumferential surface of electrode wheel 1 and of the wiping edges of wipers 11, 16 are chosen such that an optimal liquid metal film thickness profile is achieved at the discharge location with the required rotational frequency of the electrode wheel 1. By appropriately shaping and positioning the wiper (s) in combination with an adequately designed electrode wheel surface the liquid metal film can be controlled to remain stable at highest rotational frequencies and/or to concentrate at a required location on the outer circumferential surface of the electrode wheel. Examples for appropriate shapes are shown in FIGS. 3 to 7.

Figure 3:
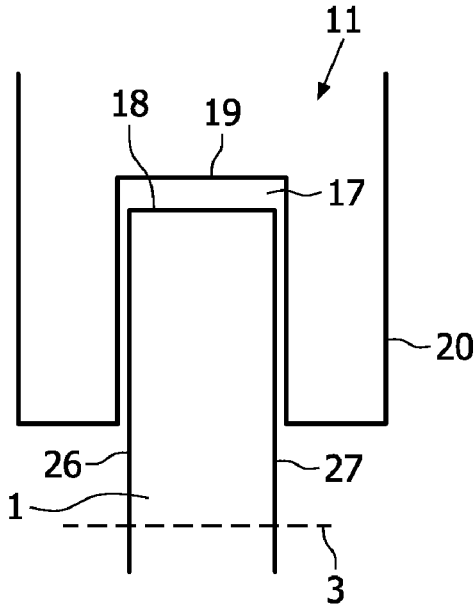
FIG. 3 a schematic view showing a cross section of a first example of a wiper unit of the proposed device.

A main feature of the present invention is the design of wiper unit 11 which is the wiper unit closest to the discharge location with respect to the rotational movement of the electrode wheel 1. This wiper unit 11 is designed to inhibit or at least reduce the flow of liquid metal from the side surfaces of the electrode wheel to the outer circumferential surface during rotation of the wheel. To this end, the wiper unit 11 can be formed of one single wiper element having a fork-like shape as shown in FIG. 3. With such a wiper unit 11 a defined gap 17 is formed between the outer circumferential surface 18 of the electrode wheel 1 and an opposed wiping edge 19 of the wiper element. At the same time liquid material on the side surfaces 26 and 27 of the electrode wheel 1 is stripped off by side pieces 20 of the wiper element and can not flow onto the outer circumferential surface 18 of the electrode wheel.

Figure 4:
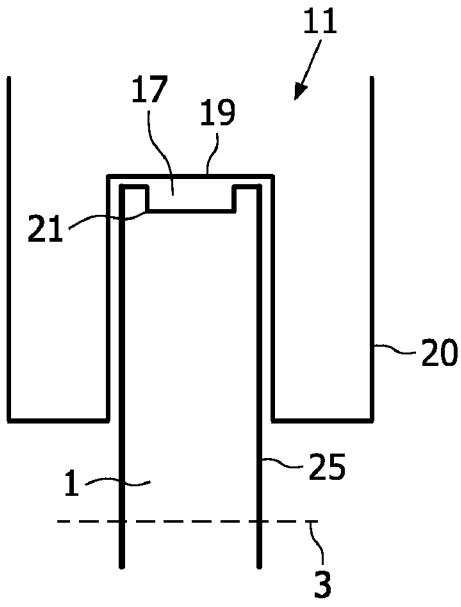
FIG. 4 a schematic view showing a cross section of a second example of a wiper unit of the proposed device.

FIG. 4 shows a further exemplary embodiment in which in addition to the fork-like shape of the wiper unit 11, the electrode wheel 1 is formed to have a groove 21 extending around its outer circumferential surface. In this case, the gap 17 between the wiping edge 19 of wiper unit 11 and the outer circumferential surface 18 of the electrode wheel 1 is defined by the depth of the groove 21.

FIG. 4 also indicates a non-wetting coating 25 on the side surfaces of the electrode wheel 1, which avoids the formation of a larger amount of liquid material on these side surfaces during rotation.

Figure 5:
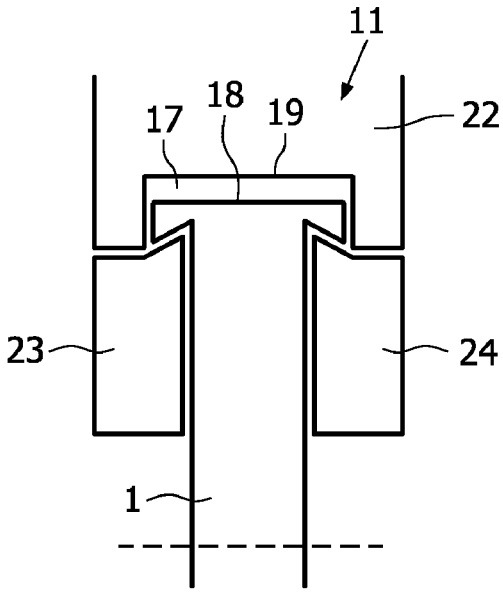
FIG. 5 a schematic view showing a cross section of a third example of a wiper unit of the proposed device.
Figure 6:
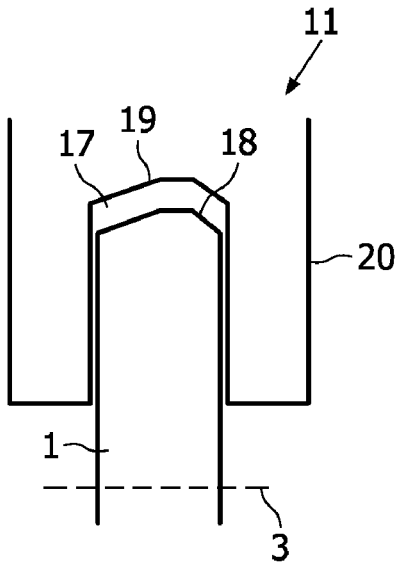
FIG. 6 a schematic view showing a cross section of a fourth example of a wiper unit of the proposed device.

In order to further restrict the migration of liquid material from the side surfaces of the electrode wheel its outer circumferential surface, the electrode wheel may have a T-shaped cross section at the outer circumferential surface as shown in FIG. 5. This T-shaped form additionally constricts the migration of liquid material from the side surfaces to the outer circumferential surface. In the example of FIG. 6, the wiper unit 11 is composed of three wiper elements 22, 23, 24. First wiper element 22 defines the gap 17 between the outer circumferential surface 18 and wiping edge 19. Second and third wiper element 23 and 24 strip off liquid material from the side surfaces of the electrode wheel.

Figure 7:
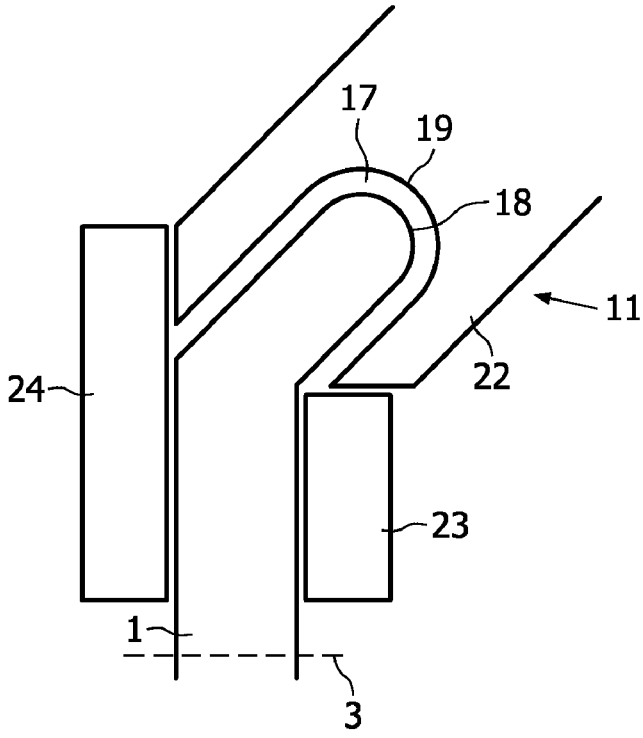
FIG. 7 a schematic view showing a cross section of a fifth example of a wiper unit of the proposed device.

FIGS. 3 to 5 have shown gaps between the outer circumferential surface of the electrode wheel and the corresponding wiping edge of wiper unit 11 which have a rectangular cross section. Nevertheless, other wheel shapes at the outer circumferential surface of the electrode wheel in connection with correspondingly adapted designs of the wiper unit may be used if the discharge location and hence the maximum film thickness is intended to be off the middle of the outer circumferential surface of the electrode wheel. Examples for such geometries are shown in FIGS. 6 and 7. With both geometries of the electrode wheel and the wiper unit the liquid material will accumulate off center with respect to the rotation plane of the electrode wheel. In FIG. 6, the wiper unit 11 is formed of one single wiper element, whereas in FIG. 7, different wiper elements 22, 23, 24 form wiper unit 11.

Figure 8:
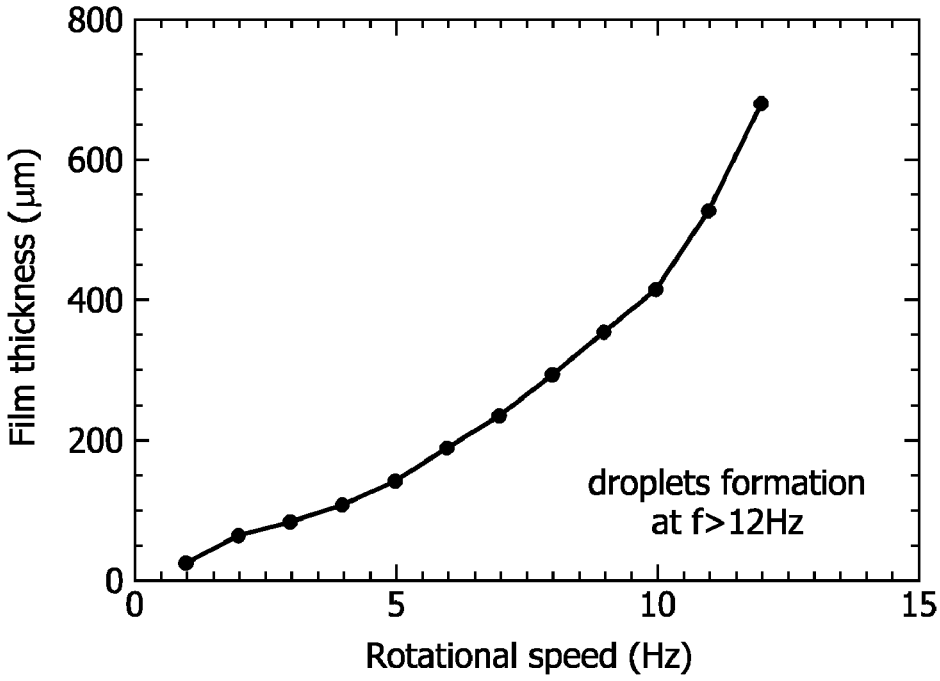
FIG. 8 a measuring diagram showing the dependence of the film thickness on the electrode wheel from the rotational speed of the electrode wheel according to the prior art.
Figure 9:
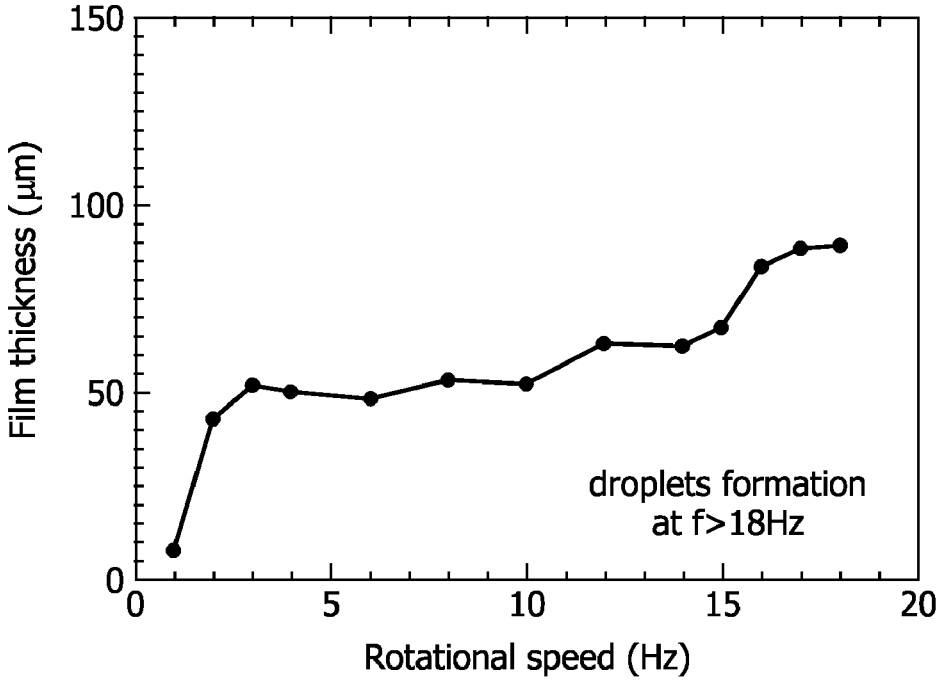
FIG. 9 a measuring diagram showing the dependence of the film thickness on the electrode wheel from the rotational speed of the electrode wheel when using an electrode device according to the present invention.

FIGS. 8 and 9 show a comparison of the dependence of film thickness at the discharge location from the rotational frequency of the electrode wheel between a discharge gas source according to the prior art which did not comprise any wiper and a discharge gas source according to the present invention. The discharge gas source of the present invention used a wiper unit according to FIG. 3. As can be seen from the diagram of FIG. 8, the film thickness of the liquid metal film in a system according to prior art significantly increases with increasing rotational speed to up to 700 μm. Droplets are formed at rotational speeds of more than 12 Hz. With the same geometry of the electrode wheel, the film thickness of a discharge source according to the present invention remains in a thickness range between 50 and 100 μm over a wide range of rotational frequencies up to 18 Hz. The formation of droplets begins at frequencies greater than 18 Hz. This means that the maximum rotational frequency could be increased by using an electrode device with the appropriate wiper unit according to the present invention from 12 Hz to 18 Hz. Thus, significant increase of repetition rate of the discharge at stable lamp operation are achieved, resulting in higher output power of the lamp.

While the invention has been illustrated and described in detail in the drawings and forgoing description, such illustration and description are to be considered illustrative or exemplary and not restrictive, the invention is not limited to the disclosed embodiments. The different embodiments described above and in the claims can also be combined. Other variations to the disclosed embodiments can be understood and effected by those skilled in the art in practicing the claimed invention, from a study of the drawings, the disclosure and the appended claims. For example, it is also possible to use more than two wiper units or to use wiper units having a different design as those shown in the figures. Furthermore, in a discharge source according to the present invention, one single or both electrodes may be designed like the claimed electrode device.

In the claims, the word "comprising" does not exclude other elements or steps, and the indefinite article "a" or "an" does not exclude a plurality. The mere fact that measures are recited in mutually different dependent claims does not indicate that a combination of these measures can not be used to advantage. The reference signs in the claims should not be construed as limiting the scope of these claims.

LIST OF REFERENCE SIGNS

1 electrode wheel
2 electrode wheel
3 rotational axis
4 container
5 container
6 metal melt
7 capacitor bank
8 feed through
9 laser pulse
10 debris mitigation unit
11 wiper unit
12 shield
13 metal shield
14 liquid metal supply
15 pinch plasma
16 pre-wiper
17 gap
18 outer circumferential surface
19 wiping edge
20 side pieces
21 groove
22 first wiper element
23 second wiper element
24 further wiper element
25 non-wetting coating
26 side surface of electrode wheel
27 side surface of electrode wheel

The invention claimed is:

1. An electrode device for gas discharge sources, the device comprising:

an electrode wheel rotatable around a rotational axis, said electrode wheel having an outer circumferential surface disposed between two side surfaces, and a wiper unit having a wiping edge, the wiper unit configured to limit a thickness of a liquid material film applied to at least a portion of said outer circumferential surface and said side surfaces during rotation of said electrode wheel, said wiper unit forming a gap between said outer circumferential surface and the wiping edge so as to inhibit migration of liquid material from said side surfaces to said outer circumferential surface during rotation of said electrode wheel.

2. The device according to claim 1, wherein said wiper unit (11) is configured to strip off liquid material at portions of said side surfaces adjacent to the outer circumferential surface during rotation of said electrode wheel.

3. The device according to claim 2, wherein said wiper unit comprises at least one wiper element having a fork-like shape.

4. The device according to claim 1, wherein the wiper unit is designed to allow an adjustment of a width of the gap, defined by the distance between the outer circumferential surface and the wiping edge, for different rotational frequencies of the electrode wheel.

5. The device according to claim 1, wherein a further wiper unit is arranged in a rotational direction before said wiper unit, said further wiper unit being designed to limit the thickness of the liquid material film on the outer circumferential surface.

6. The device according to claim 1, wherein said electrode wheel has a T-shaped cross section at the outer circumferential surface.

7. The device according to claim 1, wherein said outer circumferential surface defines a groove extending in the circumferential direction.

8. The device according to claim 1, wherein said gap has a constant thickness over a width of said outer circumferential surface.

9. The device according to claim 1, wherein said side surfaces are covered with a non-wetting material.

10. A gas discharge source comprising the electrode device according to claim 1, the electrode wheel of said electrode device forming a first of two electrodes of said gas discharge source, which are arranged to have a smallest distance at a discharge region, wherein the gas discharge source further comprises a device for applying a liquid material film on at least a portion of the outer circumferential surface of the electrode wheel.

11. A method of operating a gas discharge source according to claim 10, wherein the electrode wheel is driven with an angular rotation frequency $\omega=2\pi\cdot f$ and wherein the wiper unit (11) is adjusted in distance to the outer circumferential surface (18) of the electrode wheel to form the gap (17) with a gap area A not exceeding a maximum gap area of $A_{max}=8\sigma/(\rho\omega^2R)$, with $\sigma$ being a surface tension of the applied liquid material, $\rho$ being a density of the applied liquid material and R being a wheel radius of the electrode wheel, defined as the distance of the circumferential surface (18) to the rotational axis of the wheel.

12. The method according to claim 11, wherein the electrode wheel is dimensioned to have a width D at its outer circumferential surface, with $D^*<D<10\cdot D^*$ and $D^*=\pi\sqrt{\sigma/(\rho\omega^2R)}$.

* * * * *